US009617610B2

(12) United States Patent
Abulnaga

(10) Patent No.: US 9,617,610 B2
(45) Date of Patent: Apr. 11, 2017

(54) COKELESS REVERBERATORY FURNACE FOR MELTING IRON WITH SEPARATE HEARTH AND MELTING CHAMBER

(71) Applicant: Baha Elsayed Abulnaga, Bellingham, WA (US)

(72) Inventor: Baha Elsayed Abulnaga, Bellingham, WA (US)

( * ) Notice: Subject to any disclaimer, the term of this patent is extended or adjusted under 35 U.S.C. 154(b) by 281 days.

(21) Appl. No.: 14/336,435

(22) Filed: Jul. 21, 2014

(65) Prior Publication Data

US 2016/0017446 A1 Jan. 21, 2016

(51) Int. Cl.

| | |
|---|---|
| ***C21B 13/10*** | (2006.01) |
| ***C21B 13/00*** | (2006.01) |
| ***F27B 3/04*** | (2006.01) |
| ***F27B 3/20*** | (2006.01) |
| ***F27B 3/26*** | (2006.01) |
| ***F27B 3/10*** | (2006.01) |

(52) U.S. Cl.

CPC ..... *C21B 13/10* (2013.01); *C21B 13/0006* (2013.01); *F27B 3/045* (2013.01); *F27B 3/10* (2013.01); *F27B 3/205* (2013.01); *F27B 3/263* (2013.01)

(58) Field of Classification Search

CPC ..... C21B 13/10; F27B 3/045
USPC ..... 266/242
See application file for complete search history.

(56) References Cited

U.S. PATENT DOCUMENTS

| | | | | |
|---|---|---|---|---|
| 3,809,378 | A * | 5/1974 | Iida | F27B 3/045 266/214 |
| 4,353,532 | A * | 10/1982 | Jay | C22B 21/0084 266/242 |
| 4,844,426 | A * | 7/1989 | Barnes | C22B 21/0084 266/219 |
| 5,078,368 | A * | 1/1992 | Hemsath | F27B 3/20 266/200 |
| 2006/0027953 | A1* | 2/2006 | Nakashima | C22B 21/0084 266/212 |

* cited by examiner

*Primary Examiner* — Scott Kastler

(57) ABSTRACT

The invention relates to a process of melting ferrous metal using a gaseous fuel, a liquid fuel or a pulverized solid fuel in a cokeless horizontal reverberatory furnace (FIG. 1) consisting of a hearth (1), an sloped melting chamber (2) a vertical refractory grid (4), a burner (3), a recuperator or regenerator (5) to transfer heat from waste gas and products of combustion to fresh oxygen bearing gases, whereas a burner system is installed on the hearth for combustion of the fuel and oxygen bearing gas, the hearth under the burner acts as a superheater to achieve the temperature necessary for alloying and to receive the molten metal cascading from the sloped melting chamber, the sloped melting chamber being fed from one end by the rising gas products of combustion and in which the waste gases are subject to post-combustion of carbon monoxide and volatiles before passing through a recuperator or a regenerator to pre-heat the oxygen bearing gases necessary for combustion.

4 Claims, 2 Drawing Sheets

A representation of the Horizontal Cokeless Reverberatory Furnace with Separate Hearth and Melting Chamber

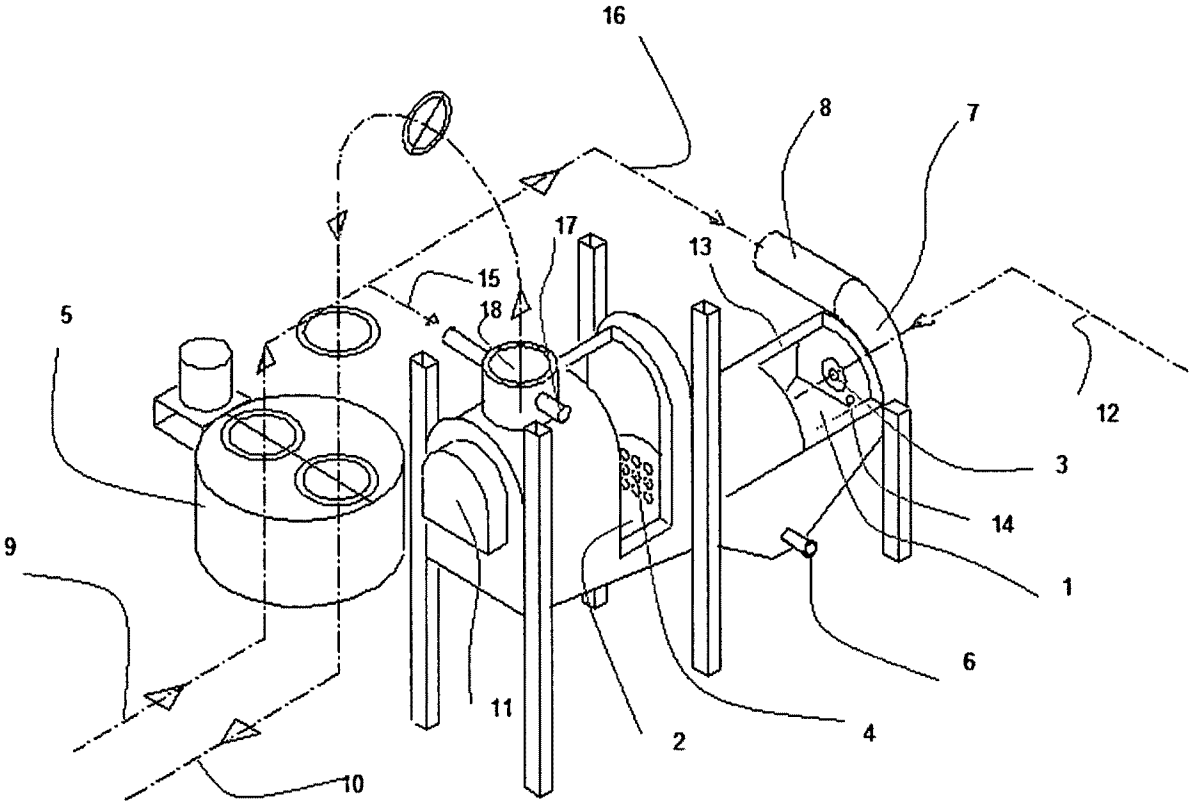
Figure (1) A representation of the Horizontal Cokeless Reverberatory Furnace with Separate Hearth and Melting Chamber

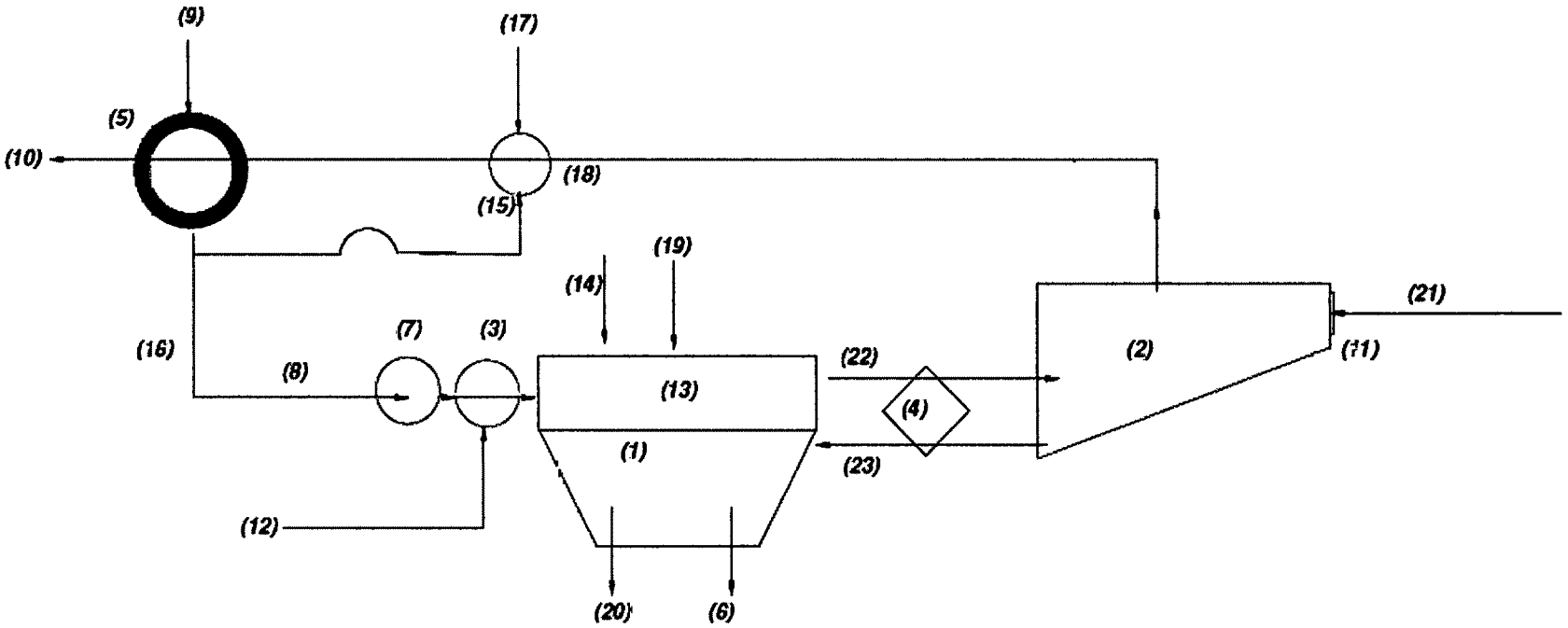
Figure 2 – Schematic of the process of melting in a representation of the Horizontal Cokeless Reverberatory Furnace with Separate Hearth and Melting Chamber

COKELESS REVERBERATORY FURNACE FOR MELTING IRON WITH SEPARATE HEARTH AND MELTING CHAMBER

REFERENCE CITED

United States Patents

U.S. Pat. No. 924,025—June 1909—Cupola—Inventor Nathaniel F. Wilshire—Assignee Nathianel F. Wilshire U.S. Pat. No. 2,734,818—February 1956—Reverberatory Furnace Practice—Inventor C. G. De Laval, Jr U.S. Pat. No. 2,755,180—July 1956—Process of Making Stainless Steel Castings in a Reverberatory Furnace—Inventor C. G. De Laval, Jr U.S. Pat. No. 3,578,302 November 1971—Gas Cupola Furnace with Special Superheat Hearth—A. A. Cherney, V. A. Grachev, M. Marienbakh, I. L. Kurbatsky, E. D. Sosnovky, N. S. Pavlenko, USSR U.S. Pat. No. 3,803,678 April 1974—Metal-Melting Furnaces—Inventors R. T. Taft, T. H. Taft PATENTS T. H. Taft—Assignee Hayes Shell-Cast (Developments) Limited.

U.S. Pat. No. 3,948,647 June 1975 Method of Melting Solid lion in a Gas Cupola A. A. Cherny, A. Grachev, M. Kirin, N. A. Gorelov—Assignee Penza USSR U.S. Pat. No. 4,758,270 March 1987—Process for Melting Metal—Inventor P. Bardenhuuer—Assignee KGT Giessereitechnik GmbH U.S. Pat. No. 4,877,449 October 1989—Vertical Shaft Melting Furnace and Method of Melting—Inventor M. J. Khinkis—Assignee Institute of Gas Technology, IL U.S. Pat. No. 4,369,955 November 1980—Cupola Furnace System—Inventor Ki D. Park U.S. Pat. No. 4,925,489 May 1990—Process for Melting Scrap Iron, Sponge Iron and/or Solid Pig Iron—Inventor Ludwick von Boglandy, Gerhard Mitter, Otto Koller, —Assignee Voest-Alpine Stahl Donawitz Gesellschaft m.b.H,

OTHER REFERENCES

Oil-fired reverberatory-cupola Wuest Oil furnace shown on page 156 to 158 of J. E. Hurst—"Melting Iron in the Cupola—Penton Publishing Co, 1929, Reprinted by Lindsay Publications Inc ISBN 1-55918-102-8

H. G Rachner—Long Term Cupola—A comparison of the familiar furnace Systems—Casting Plant Technology Issue—Part One 3/90 p 2-7, Part Two 4/90 p 8-17—1990 Giessere-Verlag GmbH, Dusseldorf—Germany

FIELD OF THE INVENTION

The field of the invention is methods, systems, and devices for melting ferrous metals, sponge iron, scrap steel, steel in a cokeless horizontal reverberatory furnace using a cokeless process and for using fuel such as gas, or oil-based fuels or pulverized solid fuel for producing the necessary heat through a two step process of melting and superheating.

BACKGROUND OF THE INVENTION

The background description includes information that may be useful in understanding the present invention. It is not an admission that any of the information provided herein is prior art or relevant to the presently claimed invention, or that any publication specifically or implicitly referenced is prior art.

The invention relates to a process of melting ferrous metal using a liquid or a gaseous fuel or pulverized solid fuel in a reverberatory furnace consisting of a hearth, an sloped melting chamber and a recuperator whereas a burner system is installed on the hearth for combustion of the fuel and oxygen bearing gas, the hearth under the burner acts as a superheater to achieve the temperature necessary for alloying and to receive the molten metal from the sloped melting chamber, the sloped melting chamber is charged from one end by moving gases products of combustion and to which is fed solid metals in a batch or continuous mode and from which the waste gases are redirected to a recuperator or a regenerator to pre-heat the oxygen bearing gases necessary for combustion, and whereas the hearth has the necessary discharge openings to remove molten metal and slag.

The melting of ferrous alloys has been done traditionally, using coke in the cupola, open-hearth and reverberatory furnaces leading to high generation of carbon monoxide and needing expensive cleaning of flue gases, or through the use of expensive electricity which is not always available in developing country. Natural gas and oil production is anticipated to increase in the years to come from multiple sources leading to new opportunities for the foundry industry by using these fuels. Natural gas particularly, and certain fuel derived gases offer a cleaner process than the coke cupola for melting iron and has been applied to the development of cokeless cupolas (U.S. Pat. No. 3,803,678) leading to a much reduced level of carbon monoxide and sulfur emissions.

Conceptually the cokeless cupola was developed to use natural gas for melting iron. The low eutectic temperature has lead to the addition of an electric super-heater, typically an induction channel furnace, on the discharge of the cupola to reach higher temperature and add graphite. This is the basis of the TAFT process (U.S. Pat. No. 3,802,678). However the capital investment in a duplex system for a TAFT cokeless cupola followed by an induction furnace has limited the use of the process in foundries.

In order to carry the charges load in a vertical shaft the TAFT cokeless cupola (U.S. Pat. No. 3,802,678). Features a water cooled grate supporting ceramic balls as a bed under the charge. The flame temperature must therefore be cooled as it passes through the grate.

In order to eliminate the use of a duplex system of a gas-fired cupola, a recuperator can be installed on the flue gases of a reverberatory—cupola furnace (U.S. Pat. No. 4,758,270)—This is also done on oil-fired reverberatory-cupola Wuest Oil furnace shown on page 156 to 158 of J. E. Hurst—"Melting Iron in the Cupola—Penton Publishing Co, 1929, Reprinted by Lindsay Publications Inc ISBN 1-55918-102-8—The author as early as 1929 claimed that the use of the recuperator would eliminate the need for duplex the cupola with an electric furnace.

In U.S. Pat. No. 4,758,270 it is proposed that the temperature of the oxygen-containing gas (air) can reach 400 to 600° C. (752 to 1112° F.) so that the flame temperature can reach at least 1800° C. (3272° F.) which is sufficient to melt iron at the temperature of 1450° C. (2642° F.)

The arrangements of a combined reverberatory-cupola furnace such as the Wuest Oil furnace uses the vertical shaft or cupola section as a charging area. It must therefore be tall or of large diameter to accept a large charge. The tall cupola cools the gases before they enter the recuperator. The said recuperator being of refractory or tube construction. For tube construction the temperature of the flue gases must be lowered to 700 degrees Celsius or 1292 degrees Fahrenheit to avoid melting the recuperator, and using special tubes in Nickel-Chromium Austenitic Steels For cokeless furnaces, whether gas fired or oil fired, carbon in a graphite form is added through a special opening under the burners.

In inventions covered by patents

U.S. Pat. No. 3,578,302

U.S. Pat. No. 3,803,678

U.S. Pat. No. 3,948,647

U.S. Pat. No. 4,877,449

The vertical shaft used to feed and charge the solid load of metal is supported by water cooled grid. This complicates the design of the cupola, and can cause a risk of explosion if the lining of the grid starts to melt away. As the flame passes through the grid it must be cooled. U.S. Pat. No. 4,758,270 tries to surmount this problem through the use of a reverberatory hearth to which the burner is connected.

U.S. Pat. No. 2,734,818 also shows a direct fired reverberatory furnace for melting stainless steel without a cooling grid. This invention requires however that the furnace be pre-heated to 3000 F. prior to charging the solid metal. However as this design does not use a recuperator, oxygen lance is used instead to achieve the required high temperatures. U.S. Pat. No. 2,734,818 also shows a method of tilting the furnace to empty it.

U.S. Pat. No. 2,755,180 also shows a direct fired reverberatory furnace for melting iron without a cooling grid. This invention requires however proper lining of the furnace with alumina-silica bricks and the use of calcium oxide to control erosion of the lining.

U.S. Pat. No. 924,025 designed for a gas fired or liquid fired cupola, a water cooled grid is not used, but the entire cupola can be inclined from a vertical position to an inclined position as needed.

The Wuest Oil Reverberatory furnace did not use a water cooled grid to support the charge, but the hearth featured sloped walls to facilitate the flow of molten metal.

U.S. Pat. No. 4,369,955 proposes that the exhaust gases from a cupola be diverted to an inclined furnace feeding the cupola, and that the charge of gray iron needing melting, compressed air and fuel are introduced with the said furnace being preferably of a reverberatory roof design U.S. Pat. No. 4,935,489 proposes that the natural gas be burned just above the stoichiometric ratio through the burner below the scrap iron, sponge or solid iron, and that further fresh air and oxygen be added above the charge to complete the conversion of excessive carbon monoxide into carbon dioxide and reduce emissions. The vertical shaft is effectively used as an afterburner.

U.S. Pat. No. 4,758,270 proposes that the natural gas be burned just above the stoichiometric ratio through the burner below the scrap iron, sponge or solid iron, and that further fresh oxygen be added above the charge to complete the conversion of excessive carbon monoxide into carbon dioxide and reduce emissions. The vertical shaft is effectively used as an afterburner.

SUMMARY OF THE INVENTION

The inventive subject matter provides a method melting ferrous metals in a horizontal reverberatory furnace consisting of two chambers, one chamber being the hearth of the furnace, acting as a superheater, and the second chamber being a sloped melting chamber, and using a cokeless melting process with a gaseous or liquid fuel, or using a process for burning pulverized solid fuel, and pre-heating oxygen containing gases needed for combustion by heat recuperation from the flue gases, being fed directly to the hearth chamber at the burners, while the metal charge or scrap needing melting being fed or stored in the second melting chamber where it is heated by the flow of combustion gases rising from the hearth, and where combustion at 95% to 120% of the stoichiometric ratio being done in the first or hearth chamber is completed above the second or charging chamber at temperature and pressure conditions that ensure the self-combustion of carbon monoxide through additional application of combustion air or oxygen carrying gases.

The invention and its advantages will become more readily apparent on examining the following description, including the drawing in which like characters refer to like parts is described in greater details hereinafter relative to an embodiment shown in FIG. 1. A schematic representation of the process is presented in FIG. 2.

BRIEF DESCRIPTION OF THE DRAWING FIGURES

FIG. 1 shows a representation of the cokeless reverberatory furnace for melting iron and steel or ferrous metals.

FIG. 2 is a schematic of the process.

DETAILED DESCRIPTION OF PREFERRED EMBODIMENTS

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

One aspect of the inventive subject matter is a system by which ferrous metals can be melted in a horizontal cokeless foundry furnace using a liquid or a gaseous fuel or pulverized solid fuel through a burner. In particularly preferred configurations and methods, as depicted in FIG. 1 and represented schematically in FIG. 2, The furnace consists of a hearth (1), an sloped melting chamber (2) a vertical refractory grid (4), a burner (3) for gaseous and liquid fuels (3), a recuperator (5) to transfer waste gas heat to fresh oxygen bearing gases whereas a burner system is installed on the hearth for combustion of the fuel and oxygen bearing gas, and a method to achieve post combustion of waste gases (15),(17),(18) between the charging chamber and the recuperator.

In FIG. 1 the hearth (1) is designed to act as a recipient of molten metal, under the burner (3). It also acts as a superheater to achieve the temperature necessary for alloying and to receive and store the molten metal from the sloped melting chamber (2). The length of the hearth must therefore be designed appropriately to exceed the length of the flame, in order to avoid contact between the flame and the separation vertical grid (4).

The roof of the hearth (1) is flat, sloped but preferably of a curved design to optimize heat transfer by radiation to the molten bath. The floor of the hearth is designed with sloped or curved sides to direct the flow of liquid metal to a spout or tap hole (6).

In an embodiment of the furnace as shown in FIG. 1 the tap hole (6), may be connected to a siphon system to separate slag from molten metal.

In another embodiment, the tap hole may be used to remove the molten metal, and an opposite tap (20) at a higher elevation used to remove the slag.

Air or oxygen carrying gases are fed from a blower via a conduit (9).

The air or oxygen enriched combustion gases are fed from a piping or ducting system (16) installed on the discharge of a heat recuperator or heat regenerator (5) of FIG. 1—with a side stream (15) connected to the roof of the melting chamber (2) at the exhaust point of the combustion gases.

The air and oxygen carrying gases feed the burner (3) above the molten metal, preferably through a swirling device shown as item (8) to achieve efficient combustion, low production of nitrogen oxides, to enhance formation of fine droplets with oil fuels or good dispersion with pulverized solid fuels. The swirler device can be of a volute form, or adjustable, with vanes to control the length of the flame while achieving good mixing of air and fuel and good dispersion of fuel.

The gaseous fuel is delivered via a gas train, the oil fuel through a piping and atomizer and the solid fuel through a conveying system (item 12) to the burner (3) or multiple burners of the furnace.

It is recommended to operate the burner (item 3) at 95% to 120% of the stoichiometric ratio, to achieve the maximum flame temperature for alloying and to control NOx emissions.

In cokeless furnaces, graphite is added under the burner through a special opening or injection point (item 14). Other alloying elements such as nodulizing magnesium are added under the burner directly to the molten metal in the state of superheating.

Heat is transferred from the combustion of fuel and pre-heated oxygen carrying air and gases to the molten bath under the burner through convection as well as by radiation to achieve high temperature for alloying and maintaining the molten metal. The hearth then effectively acts as a superheater, unit for carburization or alloying of iron, or decarburization and dephosphirization of steel.

Additional heat is transferred from the products of combustion (22) as they pass through the refractory grid (4) into the second stage melting chamber (2)

In the proposed invention, it was decided that the angle of repose of solids could be used to the benefit of a sloped melting chamber. If the floor of this combined charging and melting chamber is sloped at an angle smaller than the angle of repose of the metal in a solid form, then a sloped melting chamber can be designed to act as a feeding chamber as well as melting area. In the case of ferrous metals the angle of repose is between 30 and 40 degrees, therefore the bottom of the charging chamber should be slopped at 10 to 25 degrees.

The design of the grid (item 4) depends on the type of material being melted, and can range from a honeycomb design, to an annular design or a single orifice in different embodiments of the furnace. Its main objective is to slow down the fall of the charge into the hearth and avoid violent reactions between a cold charge and a molten bath in the hearth.

The grid (4) does not carry the full weight of the charge and does not need to be cooled for strength. Most of the weight of the charge is carried by the floor of the melting chamber (item 2).

The length and size of the charging chamber or sloped melting chamber (2) is determined by the charging capacity of the furnace and the necessary retention time needed to heat scrap steel, fresh pig iron, foundry returns, or other metals to the temperature of melting.

An access door (11) opposite to the grid, or one of the vertical walls of the melting chamber is used to charge the furnace with scrap iron, pig iron, steel, ingots and foundry returns (21)

As the products of combustion flow through the sloped melting chamber they are redirected to an exhaust conduit or stack (item 18) at the roof of the melting chamber While the products of combustion pass from the hearth (1) to the sloped melting chamber (2), a counter flow of molten metal (23) cascades from the sloped melting chamber (2) to the hearth (1) through the grid (4).

Through transfer of heat to the furnace walls, roof and the charge of metal, the combustion products drop in temperature or are quenched by contact with colder solid iron or melting charge. But having been operating at 95% to 120% of the stoichiometric ratio, they are still rich in carbon monoxide that must be converted.

At the appropriate height in the sloped melting chamber, near its roof where the temperatures of the exhaust gases are lower than 1000 degrees Celsius (1832 degree Fahrenheit), preheated air, and oxygen are injected to complete the self-combustion of carbon monoxide and reduce pollution through the conduit 15.

Fresh air and oxygen is also be injected from a separate conduit (17) to complete the combustion of carbon monoxide.

In an embodiment of the furnace that uses solid fuel, conduit 17 includes a burner to burn natural gas or oil with fresh air.

It is however important to avoid gas discharge temperature in excess of 1000 degree Celsius (1832° F.), or to exceed the conditions of equilibrium of carbon monoxide self-combustion at the points of injection (15) and (17) through the discharge (18) in order to eliminate the risk of further generation of carbon monoxide, which would defeat the purpose of carbon monoxide reduction. When this is not possible temperature must be reduced at the discharge of the recuperator or regenerator to 400° C., considered to be the optimum temperature for conversion of carbon monoxide to carbon dioxide.

These combustion products rise in temperature as the result of self-combustion of carbon monoxide, and the waste heat can be used through a recuperator or regenerator shown as item (5) to preheat the fresh and cold air and oxygen carrying gases being supplied from a blower or compressor via a piping and ducting system (9).

There are various forms of recuperators that can be used in different embodiments of the furnace, such as radiation, radiation-convection tubular or rotating type, with various materials of construction, ranging from austenitic nickel-chromium steels, to nickel superalloys to refractory construction. These have already been patented by others and can be purchased from various manufacturers. FIG. 1 shows one example of a rotating recuperator, but this is not exclusive.

The waste gases leave through conduit (10) after passing through the recuperator to a final point of dust collection and removal of emissions.

In some embodiments, the numbers expressing quantities of number of fittings properties such as melting of metals, combustion conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired conditions for melting and combustion, heat transfer sought to be obtained by a particular embodiment Notwithstanding that the numerical ranges and parameters setting forth the broad scope of some embodiments of the invention are approximations, the numerical values set forth in the specific examples are reported as precisely as practicable.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

What is claimed is:

1. A process of cokeless melting ferrous metal in a horizontal reverberatory furnace or open hearth furnace consisting of two chambers, a hearth and a charging and melting chamber, separated by a refractory grid, a perforated weir with nozzles or orifices, with the charging chamber forming a sloped melting chamber at a higher elevation than the hearth to allow the flow of molten metal from the sloped charging and melting chamber to the hearth, and where the said hearth acts as a superheater for the molten metal and comprises a burner or a series of burners for liquid, gaseous fuel or pulverized solid fuel, mixed with pre-heated air and oxygen at 95% to 120% of the stoichiometric ratio, and with the resultant gases from the combustion passing from the hearth to the sloped charging and melting chamber through the separating grid, counter flow to the molten metal, where they melt the charge before being subject to further post combustion by injection of air and oxygen at the top of the sloped charging and melting chamber prior to passage through a recuperator, regenerator or heat exchanger to preheat the air and oxygen needed for combustion at the burner.

2. A process according to claim 1 where the charge forms a sloped bed, set at an angle lower than the normal angle of repose of iron and steel in a solid form, to avoid excessive loading the grid, or separation between the hearth and the charging and melting chamber.

3. A process according to claim 1 where the hearth is separate from the charging and melting chamber and for one or more of the steps of alloying and carburization of iron, decarburization and de-phosphorization of steel and for holding the molten metal for metallurgical treatment is performed in the hearth, while melting is done separately in the charging and melting chamber.

4. A process according to claim 1 where the bottom of the charging and melting chamber is set at an angle of 10 to 25 degrees with respect to the horizontal.

* * * * *